US006260747B1

(12) United States Patent
Lam

(10) Patent No.: US 6,260,747 B1
(45) Date of Patent: Jul. 17, 2001

(54) GARMENT SUPPORTING BARS

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 09/621,887

(22) Filed: Jul. 22, 2000

(51) Int. Cl.[7] ..... A41D 27/22
(52) U.S. Cl. ..... 223/96; 223/91
(58) Field of Search ..... 223/95, 96, 93, 223/90, 91, 85

(56) References Cited

U.S. PATENT DOCUMENTS 835,481 * 11/1906 Taylor ..... 223/96
1,792,236 * 2/1931 Olson ..... 223/96
2,104,305 * 1/1938 Marble ..... 223/96
3,411,680 * 11/1968 Lundeen ..... 223/96
3,435,999 * 4/1969 Mantell ..... 223/96

* cited by examiner

*Primary Examiner*—Bibhu Mohanty

(57) ABSTRACT

An garment supporting apparatus (100) is disclosed having a stationary horizontal supporting bar (111); a movable supporting bar (121); a mounting mechanism (112, 122) enables the movable bar to rotate freely relative to the stationary supporting bar at one of the terminal ends and a engaging mechanism (126, 114) having a step shape (113, 114) enabling the other terminal end of the movable supporting bar to engage or release from the other terminal end of the stationary supporting bar.

20 Claims, 3 Drawing Sheets

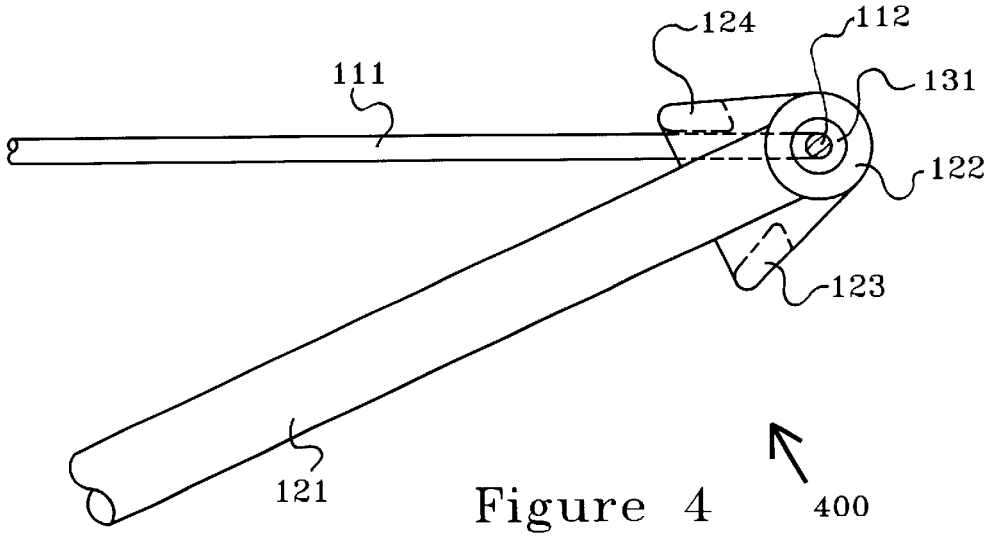
Figure 4
Figure 5
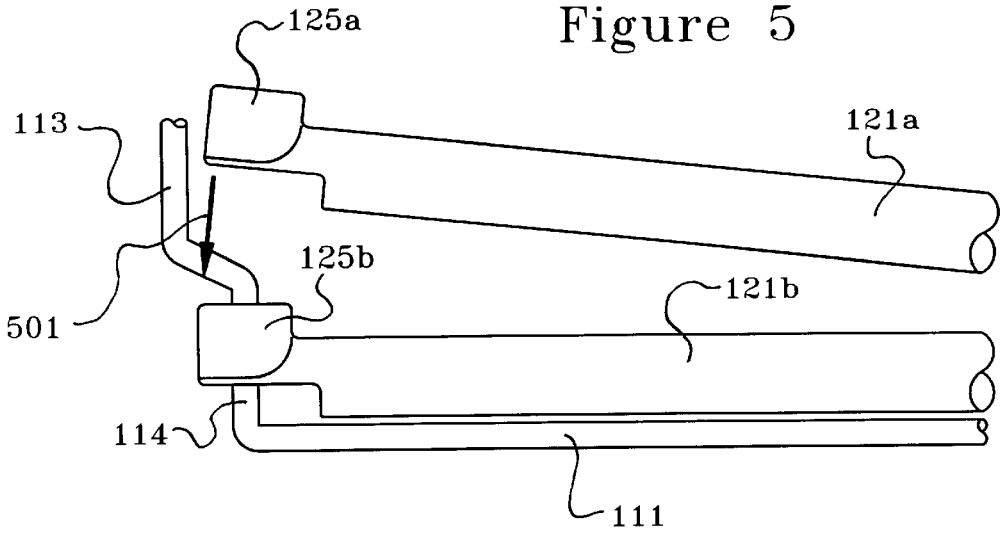

GARMENT SUPPORTING BARS

FIELD OF THE INVENTION

The present invention relates to an apparatus configured to support garment, particularly trousers and towels.

BACKGROUND OF INVENTION

Most garment hangers comprises of a hook, two supporting arms, extending in opposite directions from a medial portion, and a horizontal supporting bar connecting the two remote ends of the supporting arms to form a triangular frame. While the two supporting arms are configured to support the shoulder portion of a shirt or jacket, the supporting bar is used for hanging a pair of trousers or towel. The disadvantage of a single supporting bar is that the trousers wrap over the supporting bar tends to slip and fall during movement. In order to hang the trousers, the user is required to dress the trousers through the center hole of the triangular frame and then properly align the trousers on the supporting bar. This operation is quite inconvenient. It is the objective of the subject invention to provide a cost effective improved design of trousers supporting bars to facilitate putting the trousers onto the hanger and to provide reliable non-slipping function.

The prior art is replete with various configurations of garment hangers with dual supporting bars structured for hanging trousers and to provide non-slipping function. U.S. Pat. Nos. 2.226,786; 2,244,355; 2,340,320; 2,347,949; 2,420,196; 3,201,016; 3,402,866; 4,895,283; 5,040,707 and 5,137,191 exemplify such constructions.

SUMMARY OF THE INVENTION

The present invention is directed to a garment hanger configured with two supporting bars for supporting trousers or towels. The design objective of this invention is to provide a cost-effective solution for an easy to use and non-slipping trousers supporting hanger.

In a preferred embodiment of the invention, the trousers supporting hanger comprises two supporting bars. The first supporting bar is a horizontal stationary bar, which is part of the hanger frame. Usually the hanger frame is also connected with a hook or an alternate suspension member. The second supporting bar is a movable bar configured to comfortably supporting a pair of trousers or a towel. On one end of the stationary supporting bar is a first vertical supporting portion connected to the upper part of the hanger frame. This portion is connected to a terminal end of the movable supporting bar by a design which allows the movable bar to swing, or rotate freely about the vertical supporting portion as the axis of rotation. When an user holds the hanger frame with one hand and slightly tilted the hanger forward, the movable supporting bar will swing by the gravitational force. The other terminal end of the movable supporting bar then becomes an open end ready to receive a pair of trousers. The freely rotational trousers supporting bar is difficult to manage with one hand operation. In order to facilitate the operation, it is a secondary objective of the invention to provide a structural design to limit the angle of the swing, stopping the movable bar at a convenient rotational angle for the user to dress the trousers onto the movable supporting bar. With this stopper, the user is not required to hold the movable supporting bar, while be able to manage the position of the movable supporting bar with the hand that holds the hanger frame. This design set free the other hand of the user to fetch the trousers and align it properly onto the movable supporting bar.

Once the trousers are properly positioned onto the movable supporting bar, the user may lift up the open end of the movable supporting bar and bring it to a locking position located proximate to the other terminal end of the fixed supporting bar. There are various kinds of locking and release design suitable to serve this purpose. It is another objective of this invention to introduce a simple, low cost and easy to operate lock and release mechanism for the two supporting bars to engage or disengage. It is yet another objective of the invention to provide a low cost design enabling the two supporting bars to hold the trousers and prevent it from slipping during movement. In a preferred embodiment, the stationary supporting bar comprises a second supporting portion connected to the hanger frame. This second supporting portion is structured to provide an upper portion and a lower portion in the shape of a step. The upper supporting portion provides a span wider than the length of the movable supporting bar and therefore allowing the movable supporting bar to move around, or swing to a wide open position to receive a pair of trousers. The lower supporting portion provides a span shorter than the effective length of the movable trousers supporting bar, thus restraining the movement of the movable supporting bar. At the end of the open end terminal of the movable supporting bar is provided with a latch, a slot or any mechanical design enabling the movable supporting bar to engage the lower supporting portion of the stationary supporting bar.

Another characteristics of the preferred embodiment is that once placed in a locking position, the two ends of the movable supporting bar are restrained from moving except into the upward direction. With this design, the trousers supporting bars is self adjusted to support trousers or towel of different thickness. The free vertical movement of the trousers supporting bar also helps to create a pressure to clamp the trousers with the two supporting bars, with the movable supporting bar on top of the trousers, and stationary one at the bottom. The pressure formed is defined by the weight of the movable supporting bar and also the gravitational weight of the trousers. The higher the force pulling the trousers in the downward direction, the higher is the pressure inserted onto the movable supporting bar to hold the trousers in position. The locking and release design allowing free vertical movement is thus a preferred characteristic to support the non-slip function. It is therefore anticipated that the preferred embodiments of the invention comprise the following characteristics, such as the freely rotational supporting bar, free vertical movement of the rotational mechanism, the easy to operate lock and release mechanism combining with the free vertical movement at the locking mechanism, and the stopper helping to control the position of the movable supporting bar in the unlock position, just with the hand holding the hanger frame. All these elements contribute to a cost effective and better-performed trousers supporting hanger.

Although detailed embodiments of the invention have been disclosed, it is recognized that variations and modifications, all within the spirit of the invention, will occur to those skilled in the art. It is accordingly intended that all such variations and modifications be encompassed by the appended claims.

BRIEF DESCRIPTION OF DRAWINGS

FIG. 4 is a side view showing the remote end of the metal wire supporting bar being configured to form a step for accepting the trousers bar in a locking position.

FIG. 5 illustrates the operation of a preferred embodiment of the locking mechanism.

DESCRIPTION OF THE PREFERRED EMBODIMENTS

Figure 1:
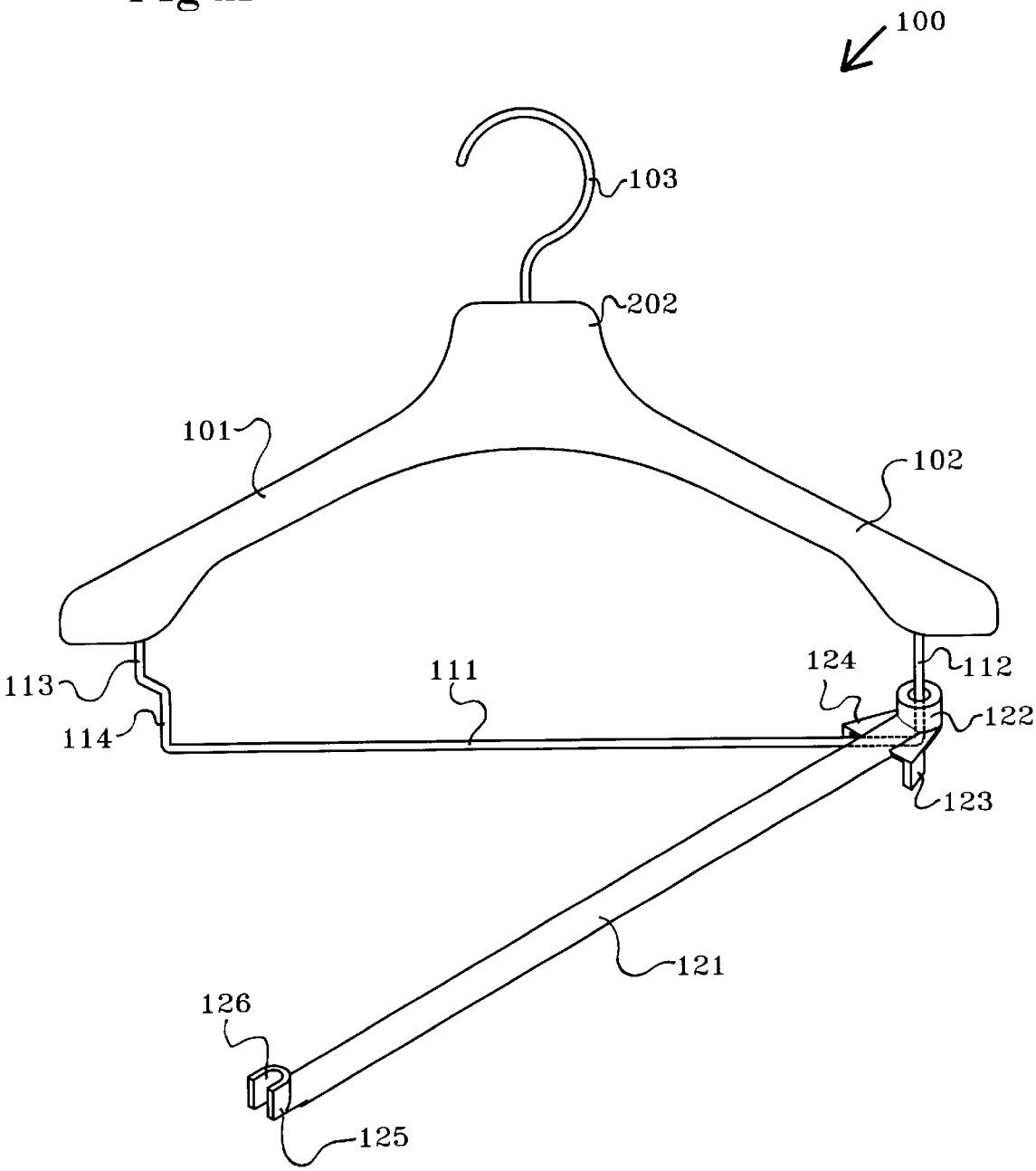
FIG. 1 is a front view of a garment supporting apparatus showing a preferred embodiment in accordance with the present invention.

FIG. 1 is an elevation view illustrating a preferred hanger embodiment 100 in accordance with the present invention. The garment supporting apparatus 100 includes a suspension member 103; a medial portion 202; two supporting arms 101 and 102 configured to support the shoulder portion of a garment; a horizontal supporting bar 111 made with a metal wire; and a trousers supporting bar 121 configured to swing or rotate about a terminal end of the metal wire bar 111.

On one end of the metal wire supporting bar is a supporting portion 112 connecting the metal wire to one end of the supporting arm 102. The other end of the metal wire supporting bar 111 is formed to provide a step represented by the portions 113 and 114. The tip of the portion 113 is connected to the end of another supporting arm 101. The upper portion 113 of the step provides a wider span measured from the remote supporting portion 112 than the lower portion 114.

The trousers supporting bar 121 has a terminal end 122 engaged with the end of the metal wire supporting bar 111. The terminal end 122 of the trousers supporting bar has a hole designed to accommodate the metal wire of the supporting portion 112; so as to enable the trousers supporting bar 121 to freely swing or rotate without any constrain from the metal wire supporting bar 111. The metal wire supporting portion 112 defines the axis of rotation.

One or more stoppers 123 and 124 are provided to limit the angle of rotation in between the trousers supporting bar 121 and the metal wire supporting bar 111. The stoppers are very important parts of the invention as they enable the trousers supporting bar to swing and stay at a reasonably wide open position as illustrated in FIG. 1, allowing an user to dress a pair of trousers or a towel through it's free end 125. Under normal operation, the user holds the supporting arm 102 with the right hand, then tilted the garment hanger 100 slightly forward. Then the trousers supporting bar will swing away from the metal wire supporting bar 111 due to the gravitational force of the trousers supporting bar 121. The trousers supporting bar 121 is preferably be allowed to rotate along the axis 112 freely for the gravitational force principle to work. After the trousers or towel is properly placed on the supporting bar 121, the user lifts up the open end terminal 125 with the left hand, bring it to the upper supporting portion 113 of the step and then let the slot 126 of the trousers supporting bar 121 engage with the lower supporting portion 114 of the step, to form a locking position. The two side walls of the slot is engaged with the lower portion 114 and prevent the trousers supporting bar 121 from removal until the terminal end 125 is lifted upward above the lower supporting portion 114.

It should be noted that the pivoting end 122 is always resting on top of the metal wire supporting bar 111. When the trousers supporting bar is positioned in the locking position, the trousers supporting bar 121 also rests on top of the metal wire supporting bar 111 and both terminal ends 125 and 122 are free to move upward from the metal wire supporting arm 111. In this position, the pressure in between the trousers supporting bar 121 and the metal wire supporting bar is defined by the gravitational weight of the trousers supporting bar 121. When a pair of trousers or a piece of towel is wrapped around the trousers supporting bar in the locking position, the pressure in between the two bars is also defined by the gravitational weight of the trousers or towel. This phenomenon is important as the heavier the weight of the trousers or the higher the downward pulling force of the trousers, the higher is the pressure formed in between the two bars which are positioned one on top of the other. This working principle provides an excellent non-slipping solution to the trousers supporting bar.

Figure 2:
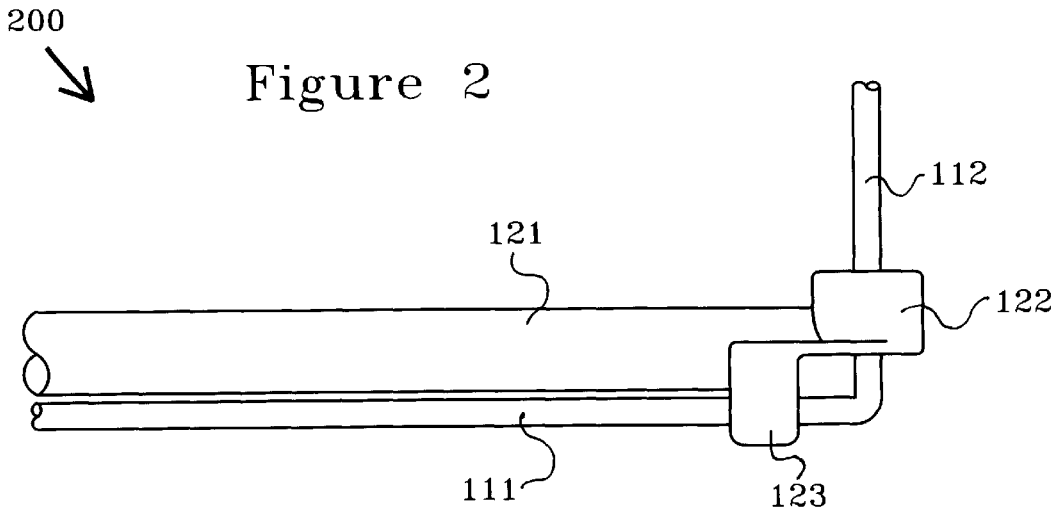
FIG. 2 is a side view illustrating a trousers bar mounted on top of the metal wire supporting bar.

FIG. 2 illustrates a side view showing the relative positions of the two supporting bars in the locking position. The trousers supporting bar 121 is positioned on top and parallel to the metal wire supporting bar 111. It can be observed that the terminal end 122 of the horizontal trousers supporting bar 121 is free to move in the upward direction, along the axis of the vertical supporting portion 112. If the terminal end 122 is designed to be tight fit with the vertical supporting portion 112 of the metal wire, the other remote terminal end of the trousers supporting bar can only be lifted with the elasticity of the trousers supporting bar, which is possible only when the supporting bar is made of elastic material. FIG. 2 also demonstrates how the stopper 123 interacts with the metal wire supporting bar 111. It is observed that the stopper 123 comprises of a downward flange, which will touch the metal wire supporting bar when the stopping angle is reached, and therefore prohibit the movement of the trousers supporting bar.

Figure 3:
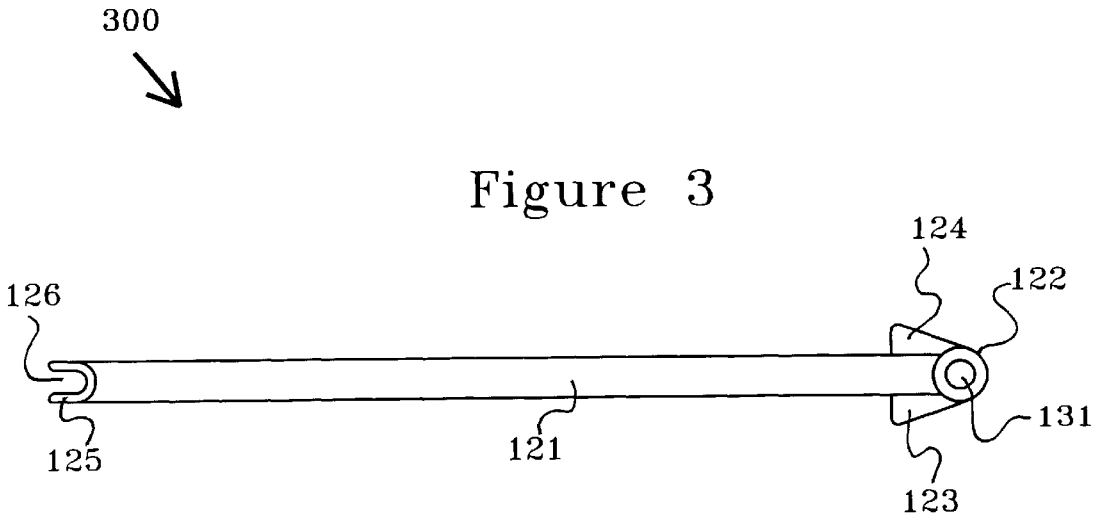
FIG. 3 is a top view of the trousers bar.

FIG. 3 illustrates the top view of the trousers supporting bar. The through hole 131 provides the pivoting or rotation axis when it is assembled with the vertical supporting portion 112. The stoppers 123 and 124 extend from the front and rear sides of the trousers supporting bar 121. The angle of the extension defines the stopping angle of rotation permitted by the trousers supporting bar relative to the metal wire supporting bar. At the other terminal end 125 of the trousers supporting bar is a slot 126, which is configured to fit into the lower supporting portion 114 of the step formed by the two supporting portions 114, 115 as illustrated in FIG. 1. Because of the special shape and structural of the trousers supporting bar, it is most preferable to manufacture the trousers supporting bar with the injection molding process.

Attention is now drawn to FIG. 4 which illustrates a magnified top view of the terminal end 122. The metal wire forming the vertical supporting portion 112 is dressed through the hole 131 located at the end of the trousers supporting bar 121. The hole 131 is made larger than the diameter of the metal wire 112 so that the trousers supporting bar is free to swing, or rotate from the metal wire supporting wire 111. The supporting portion 112 defines the axis of rotation.

When the hanger is slightly tilted forward, the gravitational force of the trousers supporting bar 121 will initiate the swing or rotational motion until the stopper 124 touches the metal wire supporting bar 111. The location of the stopper 124 is carefully selected to provide a comfortable angle of opening as illustrated in FIG. 1 to facilitate the user to put in the trousers from the open terminal end 125. Another stopper 123 may be added to provide the trousers supporting bar a limited swing angle towards the rear side of the hanger. It should be noted that although the stoppers 123 and 124 are symmetrical in the drawing, they may be modified to define different limiting angles.

FIG. 5 illustrates how the other remote terminal end of the trousers supporting bar is operated to provide the locking and release function. The supporting portions 114 and 113 extended from the metal wire supporting bar 111 is configured to form a step shape. The upper portion of the step 113 provides a width span wider than the length of the trousers supporting bar 121 and therefore allowing the trousers supporting bar to move around. The position of the trousers supporting bar 121*a* demonstrates a unlocking or released position. When the terminal end 125*a* of the released trousers supporting bar 121*a* is dropped onto the lower supporting portion 114 of the step, the slot 126 of the trousers supporting bar as illustrated in FIG. 3 engaged with the lower supporting portion 114 to define a locking position. The two side walls next to the slot 126 prohibits the trousers supporting bar to move around except in the upward direction. It is observed that trousers supporting bars 121*a* and 121*b* define the released and locking position of the trousers supporting bar respectively.

Although a metal wire is used to form the horizontal supporting bar, it is anticipated that this metal wire bar can be made with different kinds of material or process as long as the free rotating function at the terminal end 122 and the engagement and locking function at the terminal end 125 are maintained. The trousers supporting bar 121 is preferable to be formed by die casting, metal forming or injection molding to provide the special shape of the stoppers 123, 124 and the engagement mechanism 126. Although the stoppers of the illustrated embodiment extends from the two sides of the trousers supporting bar, the design can be interchanged to provide a stopper bonded to the metal wire supporting bar to limit the rotational travel of the trousers supporting bar. It should also be noted that the rotational mechanism at the terminal end 122 and the engagement and locking mechanism 126 are exemplary. Different configuration able to provide the free rotation function and the releasable engagement/locking function are also included in the scope of this invention. Accordingly, it should be understood that the embodiments described herein are exemplary and that numerous modifications, dimensional variations, and rearrangements will occur to those skilled in the art to achieve equivalent results, all of which are intended to be embraced within the scope of the appended claims.

What is claimed is:

1. A garment hanger comprising:

a first supporting bar having a first terminal and a second terminal;

a second supporting bar positioned on top said first supporting bar; said second supporting bar comprises a first terminal and a second terminal;

a rotational mechanism for engaging the first terminal of said second supporting bar to the first terminal of said first supporting bar and enabling said second supporting bar to rotate relative to said first supporting bar;

releasable locking mechanism for locking the second terminal of said second supporting bar to the second terminal of said first supporting bar; and a stopper separate from the locking mechanism extending from anyone of said supporting bars to limit the relative movement in between the two supporting bars.

2. The garment hanger of claim 1 wherein said second supporting bar is positioned on top and stays parallel with said first supporting bar when the two bars are in the locking position.

3. The garment hanger of claim 1 wherein said stopper extends from both the front and rear sides of a supporting bar for limiting the angle of rotation in both the front and the rear directions.

4. The garment hanger of claim 1 wherein the first terminal of said first supporting bar extends into a first supporting portion substantially perpendicular to the extension of said first supporting bar.

5. The garment hanger of claim 4 wherein said second supporting bar is free to rotate along a plane perpendicular to said first supporting portion; and the axis of said first supporting portion defines the center of rotation.

6. The garment hanger of claim 4 wherein the first terminal of said second supporting bar comprises a hole for engaging said first supporting portion of said first supporting bar for the relative rotational motion therebetween.

7. The garment hanger of claim 1 wherein the second terminal of said first supporting bar extends into a second supporting portion having a step; said second supporting portion is aligned substantially perpendicular to the extension of said first supporting bar.

8. The garment hanger of claim 7 wherein said step comprises an upper portion and a lower portion; the span between the lower portion of said step to the first terminal of said first supporting bar is shorter than the length of said second supporting bar extending from the first terminal of said first supporting bar.

9. The garment hanger of claim 7 wherein said step comprises an upper portion and a lower portion; the span between the upper portion of said step to the first terminal of said first supporting bar is longer than the length of said second supporting bar extending from the first terminal of said first supporting bar.

10. The garment hanger of claim 8 wherein the second terminal of said second supporting bar comprises a slot for fitting the lower portion of said second supporting portion into a locking position.

11. The garment hanger of claim 10 wherein the second terminal of said second supporting bar is configured to move outward and upward from said first supporting bar for engaging or disengaging the step of said first supporting bar.

12. The garment hanger of claim 1 wherein both the rotational mechanism and the locking mechanism of said second supporting bar are free to move upward when they are in the locking position.

13. The garment hanger of claim 1 wherein the second terminal of said second supporting bar is an open end when it is in a unlocked position.

14. A garment hanger comprising:

a first supporting bar having a first terminal and a second terminal;

a second supporting bar positioned on top said first supporting bar; said second supporting bar comprises a first terminal and a second terminal;

a rotational mechanism for engaging the first terminal of said second supporting bar to the first terminal of said first supporting bar and enabling said second supporting bar to rotate relative to said first supporting bar;

the second terminal of said first supporting bar extends into a second supporting portion having a step defining a upper portion and a lower portion;

said second supporting portion is aligned substantially perpendicular to the extension of said first supporting bar; and the second terminal of said second supporting bar comprises a slot for engaging the lower portion of said second supporting portion into a locking position.

15. The garment hanger of claim 14 wherein the second supporting portion comprises a wire for fitting the slot of the second supporting bar.

16. The garment hanger of claim 14 wherein said first supporting bar and said second supporting portion are integral parts of a wire.

17. A garment hanger comprising:

a first supporting bar having a first terminal and a second terminal;

a second supporting bar positioned on top said first supporting bar, said second supporting bar comprises a first terminal and a second terminal;

a rotational mechanism for engaging the first terminal of said second supporting bar to the first terminal of said first supporting bar and enabling said second supporting bar to rotate relative to said first supporting bar;

a releasable locking mechanism for locking the second terminal of said second supporting bar to the second terminal of said first supporting bar; and both the rotational mechanism said and the locking mechanism of said second supporting bar are free to move upward when they are in the locking position.

18. The garment hanger of claim 17 wherein said second terminal of said first supporting bar extends into a second supporting portion having a step defining a upper portion and a lower portion; said second supporting portion is aligned substantially perpendicular to the extension of said first supporting bar.

19. The garment hanger of claim 18 wherein said lower portion defines the locking position of said two supporting bars, and said upper portion defines the position for the second supporting bar to be released.

20. The garment hanger of claim 19 wherein the second terminal of said second supporting bar comprises a slot for engaging into the lower portion a locking position.

* * * * *